US006161632A

United States Patent [19]

Hovden

[11] Patent Number: 6,161,632

[45] Date of Patent: Dec. 19, 2000

[54] PURGING MEANS FOR PURGING UPWARDS IN RING SPACING BETWEEN DRILL PIPE AND BORE HOLE WALL

[76] Inventor: Magne Hovden, Olsvikveien 117, N-5074 Godvik, Norway

[21] Appl. No.: 09/051,652

[22] PCT Filed: Oct. 15, 1996

[86] PCT No.: PCT/NO96/00240

§ 371 Date: Apr. 16, 1998

§ 102(e) Date: Apr. 16, 1998

[87] PCT Pub. No.: WO97/14868

PCT Pub. Date: Apr. 24, 1997

[30] Foreign Application Priority Data

Oct. 16, 1995 [NO] Norway ..... 954100

[51] Int. Cl.[7] ..... E21B 41/00

[52] U.S. Cl. ..... 175/317; 166/222

[58] Field of Search ..... 175/38, 232, 317; 166/122

[56] References Cited

U.S. PATENT DOCUMENTS

| | | | |
|---|---|---|---|
| 1,706,072 | 3/1929 | Rieger | 175/232 |
| 1,807,837 | 6/1931 | Fortune | 175/317 |
| 1,899,728 | 2/1933 | Sandstone | 175/232 |
| 2,765,146 | 10/1956 | Williams, Jr. | 175/317 |

FOREIGN PATENT DOCUMENTS

| | | |
|---|---|---|
| 169187 | 8/1985 | Norway . |
| 9114076 | 3/1991 | WIPO . |

OTHER PUBLICATIONS

Derwent's Abstract, No. 89–277106/38, Abstract of SU 1469094 no date.

*Primary Examiner*—Brian L. Johnson
*Assistant Examiner*—Joselynn Sliteris
*Attorney, Agent, or Firm*—Fulbright & Jaworski, LLP

[57] ABSTRACT

A two-way repeatable flushing device, comprising a flushing member for flushingupwards into the annular space between drill pipe and bore hole wall or lining pipe. Flushing is ensured by means of a remotely controlled valve and a balanced pressure control by associated valve parts and by means of pressure liquid to provide a controlled distribution of the flow downwards and upwards respectively, and the hydraulic conditions are thereby improved by hole cleaning during the drilling operation itself. The solution is particularly of interest for use in particularly complicated, long-range wells having significant paths in a horizontal direction. The flushing member ensures a satisfactory hole cleaning as a consequence of improved hydraulic conditions in the annular space.

4 Claims, 5 Drawing Sheets

14b
11b
11c
10
13
20
11
11a
14a
12

47
25c
25
26
44d
44c
48
25
25
27
44
25

43a
22
21
37
20
48
23
25a
25
32a
31a
31a
26a
36
35
39
34
33
38
40
27
29a
29
31
41
42
24
44a 22
21
C
20
37
26b
32b
25b
25
23
63
31a
39
34
a
38
33
40
29
44a
24

PURGING MEANS FOR PURGING UPWARDS IN RING SPACING BETWEEN DRILL PIPE AND BORE HOLE WALL

The present invention relates to an arrangement for flushing upwards in an annular space between a drill pipe or a drill stem, which is composed of several pipe sections, and a bore hole wall or between a drill pipe/drill stem and a liming pipe, in an underground well, pressurized liquid is conducted with an axial flow through the drill pipe in order to drive a drill head and/or a hydraulic dredge motor. In addition, the pressurized liquid is used for flushing the annular space, where there is inserted in the drill pipe/drill stem a flushing member with nozzles, which are directed obliquely backwards into the annular space between the flushing member and the side wall, of the bore hole.

BACKGROUND OF THE INVENTION

In regards to well-boring operations, there are potentially big challenges in connection with complicated well paths, including deep and long horizontal sections. The need for good hole cleaning is of great significance, as the well drillings of today have hole cleaning problems. Various sludge compositions have been investigated and positive results have been achieved, but an improvement of the sludge composition alone has not been enough to solve the problems. New equipment of different design has also been tested and rotation at different speeds has been tried out in the prior art, without obtaining a reliable improvement of the hole cleaning.

A mechanical flushing device has been developed, which can be mounted in the drill stem or in other stems, such as coil pipes, "snubbing" etc., which are used in connection with well operations. The flushing device can be preadjusted for a desired percentage-wise distribution of the drill sludge, e.g., distribution of supplied drill sludge outwardly through the flushing ports and through the motor/drill head respectively. The flow distribution can be undertaken in a regulatable manner when the flushing device is activated. During drilling, provision is made for drill sludge to be supplied to the motor/drill head.

In the drilling of long wells, which are often complicated with considerable horizontal paths, significant problems have arisen in transporting drill crushings (drill material) to the surface. The development of technology has gone in the direction of higher drilling speed, something which further reinforces the problem.

During normal drilling, the annular space speed for the backward flowing sludge often becomes too slow to whirl up crushings in the annular space. Consequently, the crushings are not suspended to a sufficient degree in the sludge, with the result that the hole cleaning is too poor. The danger of dragging the drill stem along deposited crushings, for example over "stabilizators", increases the chance of packing, wedging, sludge loss, and the like. Furthermore, imperfect hole cleaning generally makes the drilling operations difficult and, by way of example, defective transport of crushings can prevent intentional side displacement ("sliding") by control in horizontal wells, with a reduced drilling speed following from this. Also, it is further known that in elongate wells there are often problems with high moment loadings. Imperfect hole cleaning is a main cause of the problems.

During the drilling operation, the drill sludge is pumped downwards through the drill stem, outwards through the drill head and further backwards through the annular space between the drill stem and the bore hole wall. When the sludge has passed the drill head and is deflected back through the annular space, the speed profile over the hole area will be different. In the horizontal path of the bore hole the drill stem will abut the low side of the bore hole, something which in turn will result in the main flow of sludge following a course into the upper portion of the cross-section of the hole. In the lower portion of the cross-section of the hole, the speed of flow will consequently become significantly lower, something which leads to the crushings being more readily deposited along the flow side of the hole cross-section. Gradually, the flow will become laminar.

By virtue of the above, the drill stem will normally have to be brought upwards from the bottom of the horizontal bore hole portion, in order to attempt to transport the crushings in a direction opposite to the drilling direction. When this is done, a hollow space will arise on the under side of the drill head and the sludge is flushed downwards into the hollow space, in order to be deflected in a direction backwards into the annular space with a subsequent loss of effect. Even with a powerful backward flow of sludge through the annular space, experience dictates that significant amounts of drill crushings are lying behind in the annular space. When introducing pipe linings, and especially when introducing extension pipe ("liner") with associated attachments and with possible associated packings, a little clearance is required. Also, during subsequent cementing, poor cleaning constitutes yet additional problems, such as increased flow resistance, sludge loss and danger of contamination, etc.

A particular aim of the present invention is the application of an inventive flushing arrangement in connection with conventional drilling operations, but in addition, an objective is also to be able to use the flushing arrangement according to the invention in other operations, such as drilling operations in predrilled, pressure-set wells.

With current techniques drill sludge is pumped by means of high pressure pumps located at the surface of the earth, in a powerful current downwards through the drill stem and outwards from the drill head, where the flow of sludge turns and returns back through the annular space whereby the return flow carrying along crushings and transporting the latter in the return flow back to the surface of the earth.

As mentioned, crushings are collected locally in the annular space which is defined between the drill pipe and the wall of the bore hole and blocks the passage through the annular space. A practical solution of the problem has been that the drill stem, after it is drilled a certain length (about 30 m) in the ground formation, is moved axially forwards and backwards in order to contribute thereby to pushing/pressing remaining crushings back through the annular space to the surface of the earth. This pushing/pressing operation is undertaken at the same time as a stream of drilling liquid is pumped downwardly through the drill pipe and outwardly through the drill head. When this pushing/pressing movement is in progress, a hollow space will result between the drill head and the bottom of the bore hole and the drilling liquid. This involves the stream of drilling liquid flowing in a powerful current downwards towards the bottom of the bore hole, in order to be reversed thereafter in the opposite direction in a counterflow against the powerful downwardly directed stream this results in a loss in effect following from this of the drilling liquid which flows further upwards in the annular space around the drill stem. Such forward and backward going movements of the drill pipe, together with the variations in the flows of drilling liquid has produced a certain movement of the crushings, which have had a tendency to be collected locally in the bore hole, but such techniques have been far from satisfactory on use in the extremely long bore holes which are drilled with prevailing techniques.

In U.S. Pat. No. 4,749,044 an arrangement is shown for flushing liquid upwards into an annular space between a drill pipe and the wall of a bore hole, in that a portion of the flow of liquid in the drill pipe is diverted out in the annular space through upwardly directed nozzle openings in the drill pipe, while a second portion of the flow of liquid in the drill pipe is restricted and is led downwards to wards the drill head. There is employed a valve regulatable with the pressure of the flow of liquid. The valve comprises an inner sleeve valve member which is axially moveable internally in the drill pipe in order to cover or uncover the nozzle openings.

In GB 2 192 217 an under member is shown, which is fixed between a drill head and an associated drill stem, which is turned by means of a rotating arrangement arranged at the surface of the earth. Drilling liquid flows from the surface of the earth, through the drill stem via an internal bore in the under member and further via a first set of permanently open nozzles through the drill head towards the bottom of the bore hole. In addition, drilling liquid flows in permanently open branch conduits through the under member, and via a second set of nozzles directly out into an annular space between the under member and the side wall of the bore hole. The second set of nozzles is directed obliquely backwards in the annular space, in order to ensure transport of drill crushings away from the drill head at the inner end of the bore hole and via the annular space in the bore hole back to the surface of the earth.

In U.S. Pat. No. 4,817,739 a pulse generator is proposed for producing a pulsating flushing effect in the annular space between the drill stem and the bore hole. The flushing effect is affected by means of drilling liquid, which is produced in a powerful flow internally through the drill stem to the drill head. From the drill head, a first set of nozzles empties out into the bottom of the bore hole, while from an under member (which is inserted between the drill head and the drill stem just behind the drill head) a second set of nozzles empties out into the annular space between the under member and the bore hole. The second set of nozzles extends in a direction directed obliquely backwards, so that a flushing jet is directed backwards through the annular space. A spring-loaded valve member is adapted to alternately open and close a first passage to the first set of nozzles, while a spring-loaded valve seat member is adapted in an opposite sequence to alternately close and open a second passage to the second set of nozzles. In step with the reciprocating movements of the valve member and the valve seat member internally in the under member, a pulsating flushing effect can be produced in the annular space around the under member.

In U.S. Pat. No. 4,749,044 a separate arrangement is shown for extracting (fishing) of equipment which is left behind in a well bore hole. The separate collecting arrangement is supplied a stream of drilling fluid through the drill stem and further via a central bore through the collecting arrangement. In addition, the collecting arrangement is equipped with a set of nozzle openings directed obliquely backwards, which empty outwards into the annular space between the collecting arrangement and the side wall of the bore hole. The nozzle openings communicate with the central bore via equivalent radial passages through a sleeve-shaped, axially moveable valve member. The valve member is axially moveable internally in the collecting arrangement against the force from a compression spring from a position with a fully open valve to a position with a fully closed valve. The valve member is held by means of the compression spring in a fully open position during downward displacement of the collecting arrangement in the bore hole. Immediately the collecting arrangement is landed on the well hole drilling arrangement left behind in the bore hole the valve member is pushed backwards to the fully closed position against the force from the compression spring.

The blocking problems have constantly increased because the bore holes are drilled constantly for longer periods of time, while at the same time, the paths of the well bore holes are becoming correspondingly complicated.

There are various problems which have to be solved in connection with the backward flow of the return liquid to the surface. This is due to the rheological properties of the drilling liquid, combined with the speed of the return liquid (drilling liquid with drill crushings) in the annular space between drill pipe and drill stem and the sidewall of the bore hole being necessarily relatively low, something which gives an unsatisfactory flow effect when transporting the crushings in the return liquid to the surface.

Recently there has been much investigation on improving the flow conditions of the drill sludge, which generally constitutes the transport fluid (liquid or sludge), which transports the crushings away from the drill head and over/upwards to the surface. At times the problem has been so big that the arrangement has stuck fast in the bore hole based packing of crushings around the drill stem/drill pipe, with significant loss of time, equipment and income following.

On drilling vertical or substantially vertical bore holes in a land-based or ocean-based location ground formation, strings of pipe coupled together in sections have hitherto been employed, which are rotated by drive means from the surface of the earth. In such, connection a technique is employed with which a pull is exerted in the drill stem from the surface so as to relieve portions of the weight loading arising in the drill stem.

In order to be able to utilise the gas or oil deposits which are present in the ground formations optimally and thereby get uncollected larger amounts of these deposits, lateral well bore holes have been made use of in recent years to a steadily increasing degree. In this connection a technique has been put into use, whereby the course of the well bore hole can be allowed to bend from a substantially vertical path to a substantially horizontal path, in order thereafter to continue the bore in the form of a lateral branch bore hole outwards in the ground formation.

In more recent times, where in addition to vertical or substantially vertically extending bore holes the drilling is continued in a horizontal or substantially horizontally extending direction (over to in part large horizontal stretches), a pipe conduit is usually employed, which is coilable on a reel instead of using strings of pipe which can be coupled together in sections. In such a connection, a technique is employed where, in addition to the weight loading of the drill stem, an extra pushing force has been supplied in the coilable pipe conduit in order to propel the drill head in the drilling direction. This technique has involved the drill pipe having a tendency to buckle in a winding course in a horizontal as well as in a vertical plane and to form locally an abutment against the wall of the bore hole on the so-called "low side".

In practice, it has been found that by using coilable pipe conduit, a tendency occurs for blocking by drill crushings particularly on the low side of the drill pipe, something which can cause still greater danger of blocking the transport of the drill crushings in the annular space around the drill pipe.

SUMMARY OF THE INVENTION

With the present invention, the aim is to provide a new and advantageous solution based on a novel constructional solution and a novel mode of operation.

The arrangement according to the invention is characterised in that the flushing member in itself forms a remotely controllable valve comprising an outer sleeveshaped valve part and an inner sleeve-shaped valve part, which are connected to their respective sections of the drill pipe, the outer valve part forming a valve seat member, in which the nozzles are designed in an annular series together with passages between the nozzles and valve openings in the valve seat member, while the inner valve part forms a slide-shaped valve body for opening and closing the valve openings, and that the valve parts are axially moveable a limited length of movement relative to each other by remotely regulating the tension/pressure loading in the drill pipe/drill sten, pressure liquid chambers between the valve parts being defined for cushioning and balancing axial movement of the valve parts relative to each other.

In the arrangement according to the invention, several significant advantages are achieved. A particular advantage is that with the aid of simple means, the flushing operation can be effected with the desired flushing effect immediately by remote control from the surface of the earth, without substantial interruption of the drilling operation. By means of pressure medium control on the inner side and on the outer side of the flushing member provision is made for being able to secure the valve in place in fully open and fully closed positions respectively and ensuring thereby a controlled operation of the extra flushing function via the nozzles as required.

As mentioned, the motor/drill head is supplied 100% of the flow of drill sludge during the drilling operation. It is particularly advantageous that intermittently e.g., between two drilling operations) a two-current flushing can be carried out at the same time as the drill motor runs and the drill head is cooled. Turning of the drill head (certainly with some reduced flow of the pressure liquid observed) can hereby be continued, also in the intermittent flushing phase with an open valve. The drill head can hereby be effectively kept in operation at the same time as the need for a circulation valve or other similar measures is eliminated.

The distribution of the flow of sludge on the flushing nozzles and drill motor/drill head occurs on weight relieving or weight loading of the drill stem. More specifically, the whole of the flow of sludge is supplied during the drilling operation via the drill head to the annular space, while on relieving weight of the drill stem, a relative pull is exerted in the drill stem which involves opening of the valve and whereby the flushing ports are opened for flushing through the annular space. Subsequent to the weight loading, the valve and the flushing ports close and the drilling operation continues. This procedure can be repeated an unlimited number of times as required.

The flushing arrangement is constructed hydraulically so that it normally has a positive closing force, which is proportional to the pressure of the sludge internally in the flushing arrangement. This pressure is adapted to each tool dimension and each hole section diameter. For example, in a 12.25" hole section there can be employed a closing force of 3000 kp at 220 bar. This force can be adapted according to the wishes of the operator. The flushing arrangement can, if desired, be produced so that the closing force is approximately equal to zero.

The flushing arrangement is placed at a specific, desired length above the drill head/motor and can, for example, be placed in tandem.

Once the weight is relieved from the drill stem and the flushing arrangement is activated, a pressure drop will be observed. The pressure drop emerges, inter alia, as a result of getting less friction loss. If pump capacity is available, this can be utilised to compensate for the pressure drop.

When the drill pipes are drawn ("tripped") out for the last time, one can pump them out continuously bore pipe by bore pipe and until one finally obtains a clean hole.

The ideal in the solution according to the invention is that when the flushing arrangement is first installed in the drill stem, one can (in practice) imagine that the flushing arrangement is there. The flushing arrangement will always close on each starting up of the normal drilling sequence and thereby ensures that the total quantity of sludge during the drilling operation is brought via motor and drill head back to the annular space.

According to the invention, one is not dependent on effecting the flushing in combination with or just by the is drill head, but the flushing can be undertaken at various locations along the drill pipe/drill stem. As required, two or more flushing members can furthermore be employed arranged in series (in tandem) after each other in the drill pipe/drill stem based on the afore-mentioned principle with remote control of the flushing members. The extra, intermittent flushing via several flushing members can take place in one and the same operation by means of the liquid pressure which acts internally in or externally on each flushing member. Provision can be made for balancing of the valves in a fully closed or fully open position in order to ensure accurate control of the flushing operation.

According to the invention, the intermittent flushing operations can be repeated to an unlimited extent, according to desire and need. The result is that, by simple means, an increased drilling speed can be ensured by reducing the clean up time with intermittent flushing and facilitating the transition from the flushing phase to the drilling phase with a full drilling effect. In practice, there is a documentable time saving of 10% by testing on Gullfaks B (B-32) in a 12¼" hole section with a section length of 760 m. Generally, better hole cleaning is obtained and the danger of wedging of the drill pipe/drill stem with associated drill head is prevented. With the afore-mentioned testing on Gullfaks B it was measured that the crushings which are delivered in return, relative to the drilled formation was close to 100%. It was found that the twist moment was low relative to earlier experiences and that control ("sliding") was very satisfactory.

In practice, the arrangement is further characterised in that the outer valve part is in permanent rotary engagement with a first drill pipe section, which carries the drill head and the second valve part is in permanent rotary engagement with a second drill pipe section, which is remotely controlled from the surface of the earth, the mutually axially displaceable valve parts being connected to each other in permanent rotation via key/slot connections between the valve parts.

The afore-mentioned results in the readjustment between the drilling operation with maximum drilling effect and the intermittent flushing operation with reduced drilling effect being able to be undertaken by simple remote control by regulating the pushing force against the drill pipe/drill stem, while at the same time, ensuring continuous rotation of the drill head from the drilling operation to the intermittent flushing operation, and back to the usual drilling operation.

Further features will be evident from the following description having regard to the accompanying drawings, in which:

DETAILED DESCRIPTION OF THE INVENTION AND PREFERRED EMBODIMENTS

Figure 1:
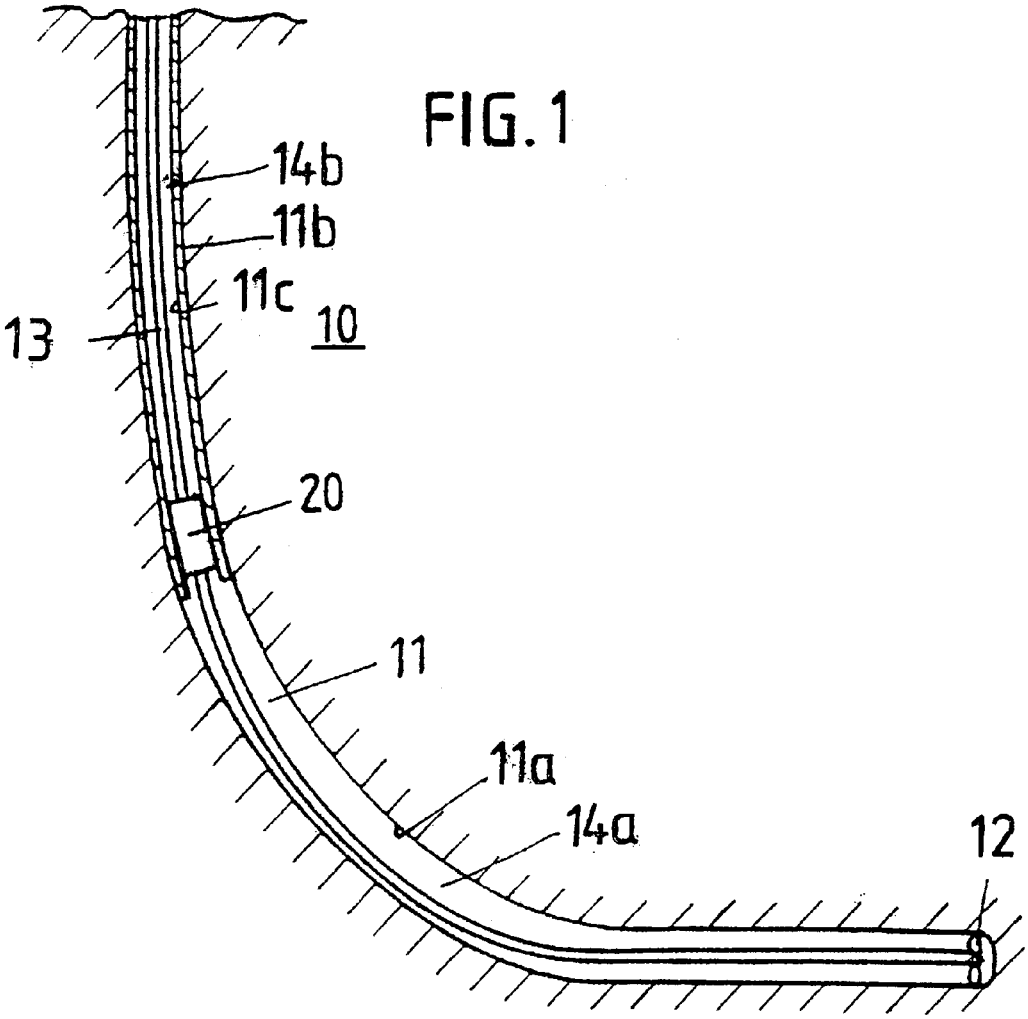
FIG. 1 shows schematically, in side view a drill pipe having a flushing member, according to the invention, arranged in the transition between a vertical and a horizontal path of a bore hole in the subsoil.

In FIG. 1 an underground formation 10 is shown having a bore hole 11 which is drilled with a drill head 12 connected to a drill pipe 13, which, in the illustrated embodiment is in the form of a drill pipe coilable on a drum. Alternatively, the drill pipe can be replaced by a drill stem which is composed of a series of successive pipe sections. In a horizontal portion of the bore hole 11, an annular space 14*a* is shown between the drill pipe 13 and the inner wall 11*a* of the bore hole. In a vertical portion of the bore hole 11, a lining sleeve 11*b* is shown with a corresponding inner wall 11*c*, which defines an equivalent annular space 14*b*.

In the illustrated embodiment there is shown, as pure illustration, a flushing member 20 according to the invention placed in a curved transition portion between the said vertical and horizontal portions of the bore hole 11. The distance between the drill head 12 and the flushing member 20 can be in the schematically illustrated example 1000 m, for example in the longitudinal direction and 350 m in the height direction. It can be understood that the flushing member 20 can be employed during drilling of the vertical and of the horizontal portion of the bore hole in a manner corresponding to that shown in the transition portion as illustrated in FIG. 1.

If desired, two or more flushing members can be employed in series with a mutual distance corresponding to that shown between the drill head and the flushing member according to FIG. 1 or with a larger or smaller distance as required.

Internally in the control member 20 there can be arranged, if desired, a sludge motor (not shown further) which can be driven by the flow of pressure medium which passes through the control member 20.

Figure 2:
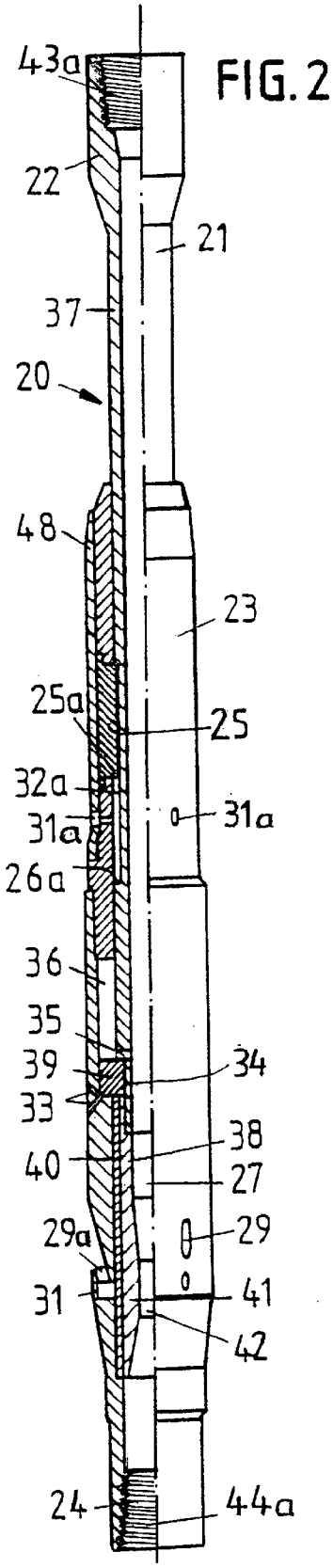
FIG. 2 and 3 show the flushing member partially in vertical section and partially in side view in two different outer positions.

The main component of the arrangement according to the invention constitutes a selectively controllable flushing device, as shown in more detail in the flushing member 20 of FIG. 2. The function of the flushing device is controlled from the surface of the earth by regulating the tractive force between a first part 21, and a second part 23 of the under member 20, that is to say, by relieving some of the tractive force so as to start the flushing effect and to backward adjust the pushing force in order to stop the flushing effect.

Figure 3:
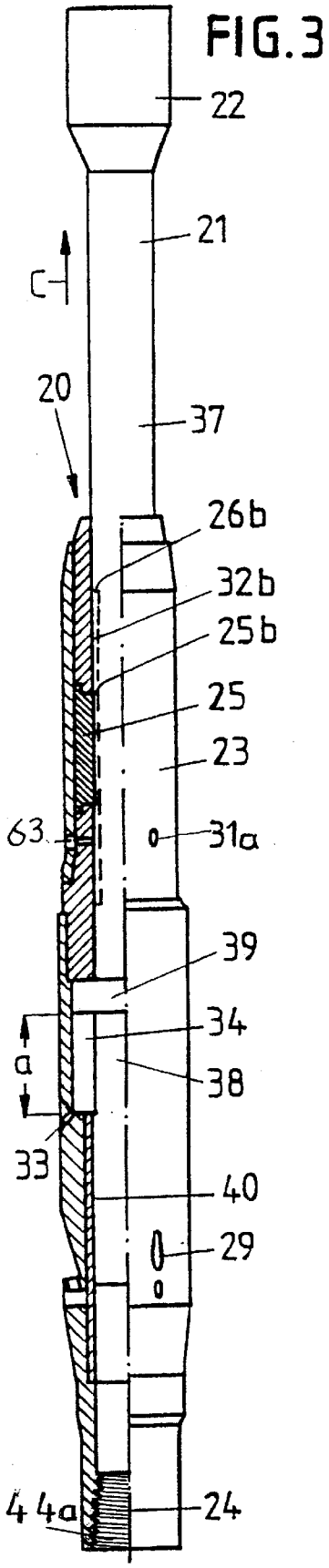
Figure 5:
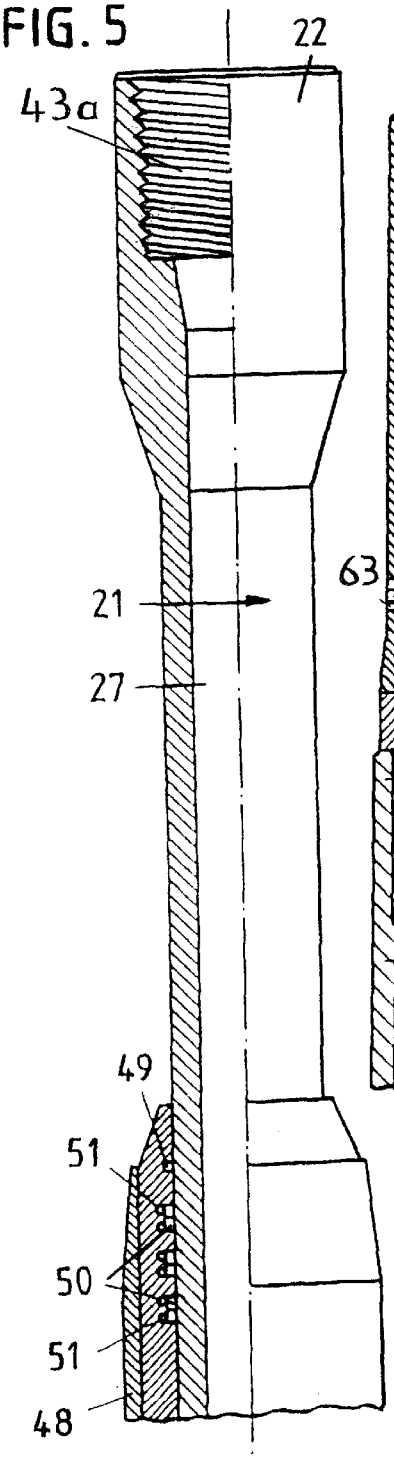
FIG. 5–7 show sections of FIG. 2 on a large scale.

In FIG. 2 the flushing member 20 is shown in the form of an inner valve part 21 with an associated internally threaded coupling box 22 and an outer valve part 23 with an equivalent internally threaded coupling box 24 for coupling together adjacent components connected to a drill head. The said two parts 21, 23 of the flushing member 20 shall absorb the torsion and pressure forces or the tractive forces, which the flushing member 20 is subjected to during the drilling operation. The valve parts 21, 23 are axially movable relative to each other a certain distance a in order to be able to adjust the flushing member 20 in two opposite functional positions. In a first outer position, as shown in FIG. 2, the flushing device is unactivated, while in a second outer position, as shown in FIG. 3, it is adjusted into the flushing position.

Figure 6:
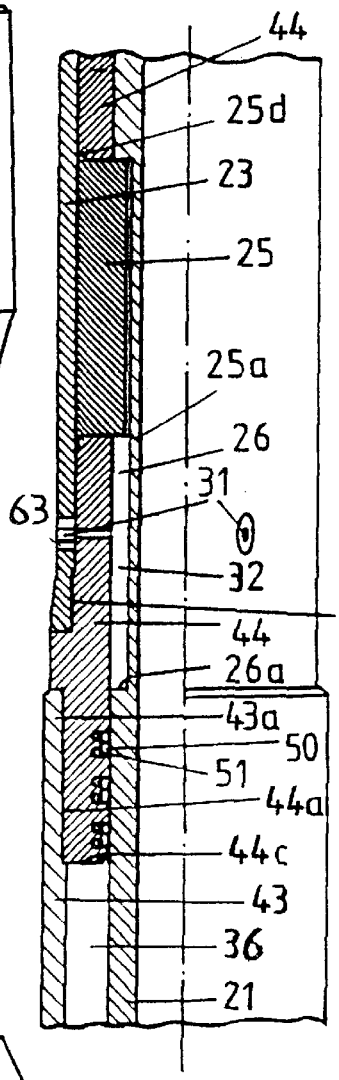

The relative movement distance of the valve parts 21, 23 is determined by an annular set of four keys 25 (see FIG. 4 and 6), which are secured internally in the outer valve part 23 and which are guided in an equivalent set of four axially extending control slots 26, which are designed on the outer side of the inner valve part 21. The valve parts 21, 23 are consequently connected to each other for permanent rotation.

Figure 7:
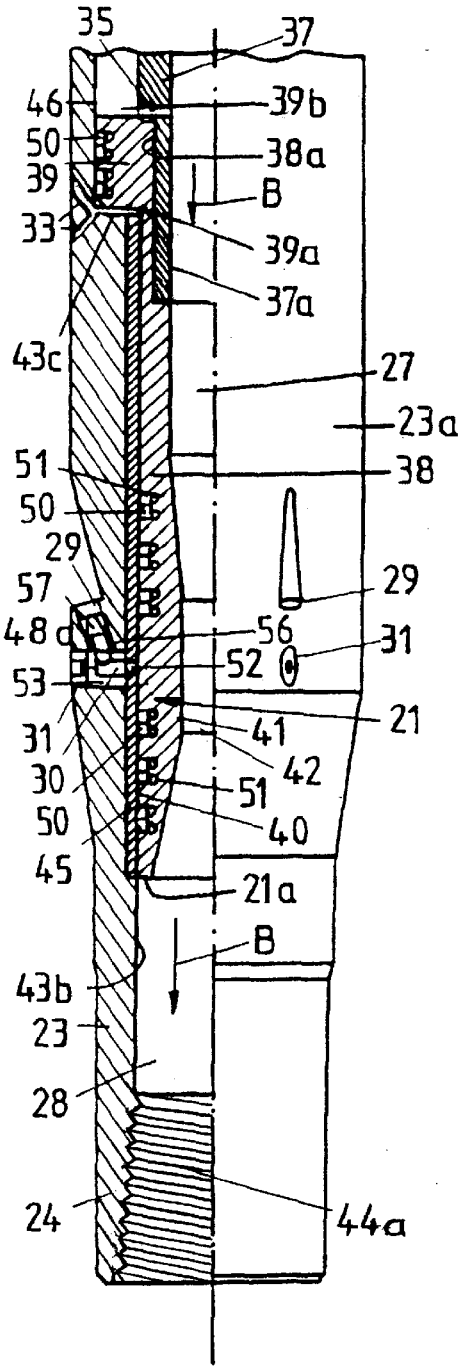
Figure 8:
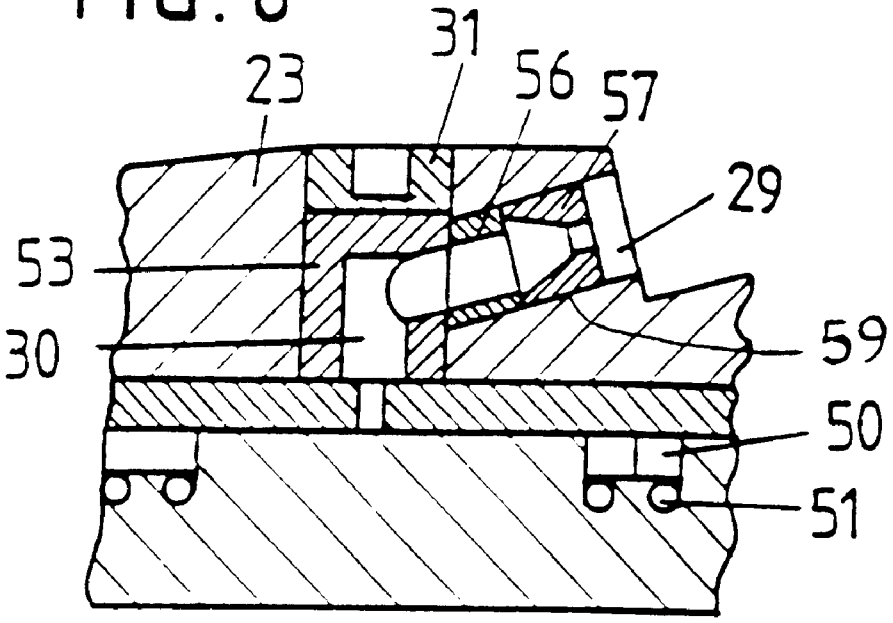
FIG. 8 shows in cross-section a section of the flushing member and an associated flushing nozzle on a large scale.

A central passage 27 and 28 (see FIG. 7) is defined internally in the inner valve part 21 and in the outer valve part 23 for permitting the free flow of drilling liquid through the flushing member 20, as is indicated by the arrows B. At the starting point the whole flow of drilling liquid is supplied via the flushing member 20 to the drill head, but in the periodic flushing phase 60% for example of the flow is branched off directly to the nozzles, while the remainder, 40% of the flow is fed to the drill head.

In a central portion 23*a* of the second part 23 (see FIG. 7) of the under member 20, a set of is for example three nozzles 29 is designed for extending obliquely outwards and backwards, so as to communicate with their respective radial bores 30 through the wall of the valve part 23. Radially outermost area of radial bore 30 is covered with a lock cover 31, while radially innermost in the one outer position, shown in FIG. 2, is covered by the innermost end of the inner valve part 21 of the flushing member 20. In the second outer position, shown in FIG. 3, the innermost end of the inner valve part 21 is drawn axially back, relative to the outermost valve part 23, so that the radial bores 30 and the respective nozzles 29 communicate directly with the flow of liquid, which passes through the flushing member 20.

The backward drawing of the inner valve part 21 from the position in FIG. 2 to that in FIG. 3, occurs by exerting a relative tractive force, as shown by the arrow C in FIG. 3, against the inner valve part 21 via the drill pipe/drill stem.

Alternatively to the illustrated embodiment, the outer valve part 23 can be fastened to that part of the drill pipe/drill stem which is connected to the drill head 12, while equivalently the inner valve part 21 can be connected to the remaining part of the drill pipe/drill stem (not shown further herein).

Internally in the flushing member 20, provision is made for balancing the parts 21 and 23 relative to each other by means of pressurized liquid. The balancing is effected in the one direction of movement by means of return liquid, which is supplied from the annular space via ducts 31 a to respective slot chambers 32 and via ducts 33 to a first annular chamber 34 between the parts 21, 23. The balancing is effected in the other direction of movement by means of drilling liquid, which is supplied from inner passage 27 of the flushing member 20 via ducts 35 to a second annular chamber 36 between the parts 21, 23.

The inner valve part 21 of the flushing member 20 comprises a forward main section 37 and a rear control section 38. The main section 37 carries at its rear end a screw-threaded joint portion 37*a;* which is fastened to the rear control section 38 via an equivalent screw-threaded portion 38*a*. In the joint portions 37*a,* 38*a* ACME-6 threads are employed, that is to say, threads having a trapetoidal cross-section. Externally on the joint portion 38*a* the control section 38 is provided with a piston-forming collar portion or flange 39 projecting radially outwards. On the inner side the control section 38 is provided with a thickened wall portion 41, which forms a Venturi passage 42 at the end of the passage 27.

Correspondingly, the outer valve part 23 of the flushing member 20 comprises a rear outer housing 43, which forms a main section, and forward anchoring section 44. The outer housing 43 and the anchoring section 44 are fastened together via equivalent screw-threaded joint portions 43*a* and 44*a* in rigid connection with each other. As screw threads MS-threads are employed, that is to say, threads having a rectangular cross-section.

Innermost the outer housing 43 is provided with a first cavity 45, in which a wear lining-forming sleeve portion 40 is shrunk on for slidable reception of the control section 38 of the inner valve part 21. There is shown the equivalent end face of the control section 38 projecting radially within inner face 43*b* of the outer valve part 23, e.g., of the main part 43, to form a first piston face 21*a,* which is pressure loaded by drilling liquid in the passage 28 in the outer valve part 23.

Between the screw-threaded joint portion 43*a* of the main section 43 and the first cavity 45, there is a second cavity 46 designed for displaceable reception of the piston-forming collar portion or the flange 39 on the control section 38 of the inner valve part 21. The collar portion 39 has a second piston face 39*a,* which faces towards an equivalent shoulder 43*c* in the outer housing 43 of the outer valve part 23 and a third piston face 39*b,* which faces towards an equivalent shoulder 44*c* in the anchoring section 44 of the outer valve part 23. The afore-mentioned first annular chamber 34 (see FIG. 3) is defined between the piston face 39*a* and the opposite radial face 43*a* in the main section 43, while the second annular chamber 36 (see FIG. 2) is defined between the piston face 39*b* and the opposite radial face 44*a* in the anchoring section 44. Correspondingly, in each slot a first slot chamber 32*a* is defined between one end face 26*a* of the control slot 26 and the opposite end face 25*a* (FIG. 2) of the associated key 25 and a second slot chamber 32*b* between the second end face 26*b* of the control slot 26 and the opposite end face 25*b* (FIG. 3) of the key 25.

The inner part 21 of the flushing member 20, including the main section 37 and the control section 38, plus the outer part 23 of the flushing member 20, including the main section 43 and the anchoring section 44, together with a sleeve shaped cover 48, are made of steel of the type ANSI4045H. All internally uncovered portions of the flushing member 20 are coated with Wolfram (tungsten carbide) or similar (for example, ceramic) material so as to prevent scouring by the flowing drilling liquid.

On the inner face of the anchoring section 44 of the valve part 23, fastened in at its rear end, is a scraping ring 49 for scraping off possible deposits on the outer face of the main section 37 of the inner valve member 21. Axially within the scraping ring 49 arranged in series are three pairs of radially inner Teflon rings 50 and equivalently three pairs of radially outer O-rings 51. Correspondingly, in series at the opposite end of the anchoring section 44, in three pairs of radially inner Teflon rings 50 and three pairs of radially outer O-rings 51 are fastened.

On the outer face on the control section 38 of the inner part 21 there are fastened, equivalently in series, (as determined from the inner end of the control section) three pairs of radially outer Teflon rings 50 and three pairs of radially inner O-rings 51 and an additional set of three pairs of radially outer Teflon rings 50 and three pairs of radially inner O-rings 51.

On the outer face of the piston-forming collar portion 39 of the control section 38 there are fastened in series two pairs of radially outer Teflon rings 50 and two pairs of radially inner O-rings 51.

The wear lining-forming sleeve portion 40 is made of hard steel, that is to says carbon steel which is hardened to 1000 Brinell. The sleeve portion 40 has a bore 52, which communicates with the radial bore 30 in the outer valve part 23 of the flushing member 20. In the radial bore 30 just within the lock cover 31 an insert part 53 made of tungsten carbide is shut off. The cartridge 53 is provided with a first bore flush with the bore 52 and a transverse second bore flush with a sleeve 56, which is made of tungsten carbide and which is arranged together with, that is to say axially just within an insert member 57 in a bore directed obliquely backwards. The insert member 57 forms the said nozzle 29, as mentioned above. The insert member 57 and the associated sleeve 56 are locked in place in said oblique bore by means of a locking ring 59. In the illustrated embodiment, an insert member 57 is employed, where nozzle opening 29*a* of the nozzle 29 has a cross-sectional diameter of 5.9 mm. The aim is the ready replacement of nozzles having larger or smaller nozzle openings as required.

Figure 9:
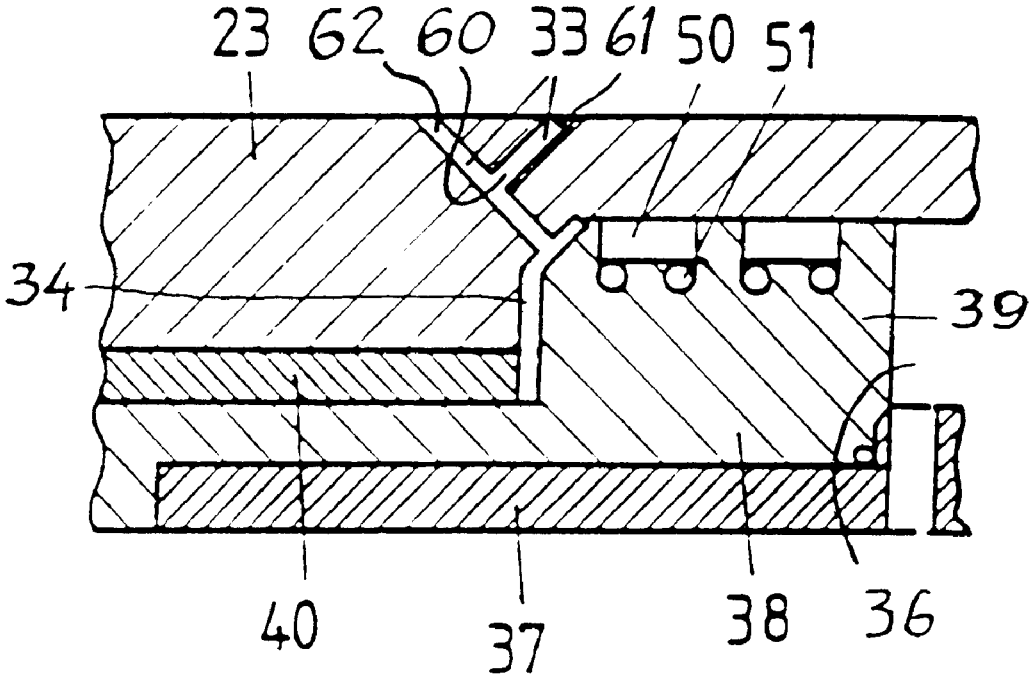
FIG. 9 shows in cross-section a section of another portion of the flushing member on a large scale.
Figure 10:
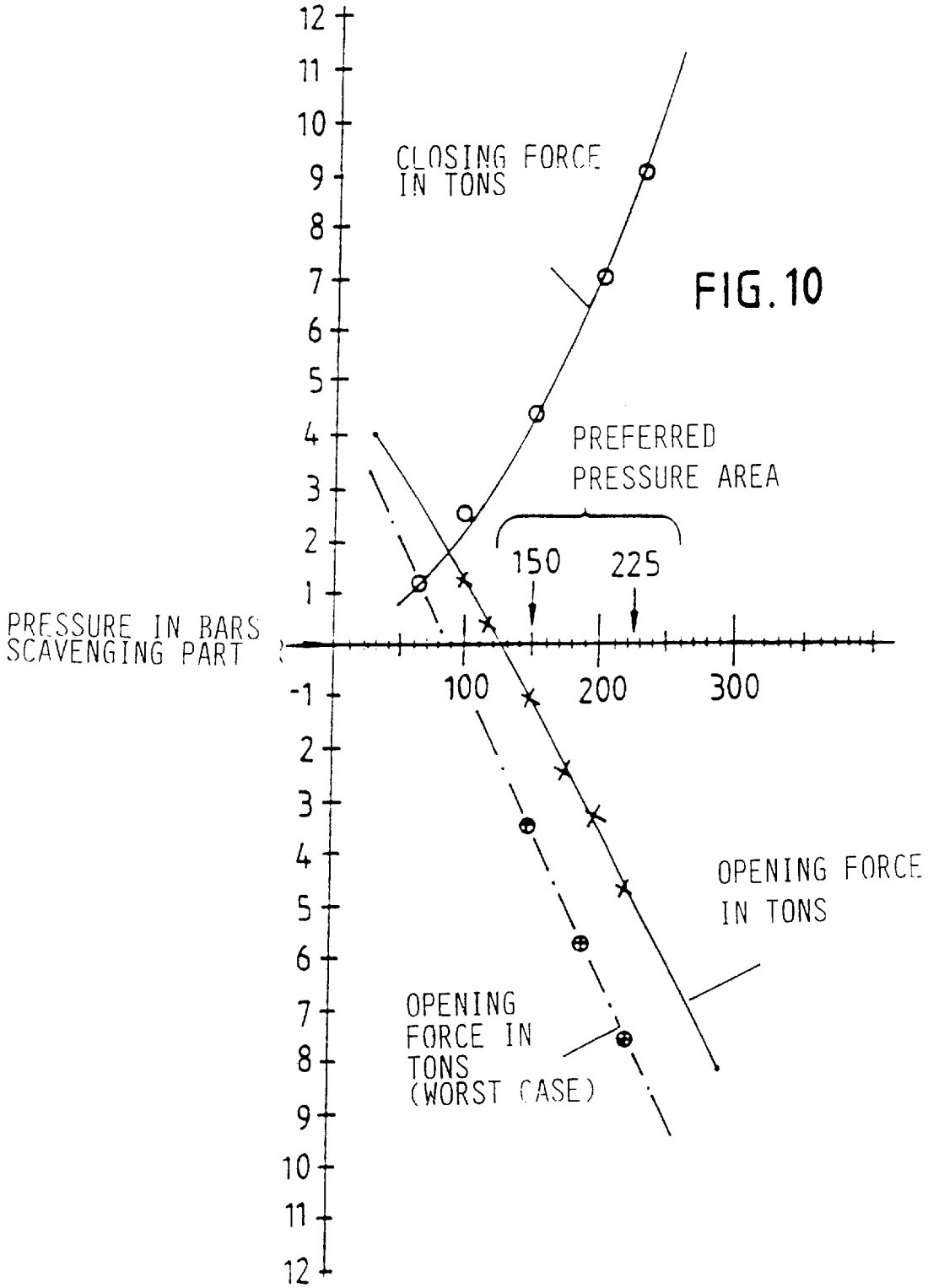
FIG. 10 shows a diagram of opening force and closing force in the flushing member relative to the actual placing of the flushing member relative to the drill head.

The ducts 33, to said second annular chamber 34 (see FIG. 3 and 9) are formed by a first forwardly directed bore 60, which is closed outermost by means of a set screw 61 and by which a distance inside the set screw 61 communicates with a second backwardly directed, transversely extending bore 62.

The ducts 31 to respective slot chambers 32 are extended through the sleeve-shaped cover 48 having a duct portion in which a nipple 63 having an associated bore is inserted.

The keys 25, which are made of CNC-16 material are, shrunk into place in cavities 44*d* in the anchoring section 44, while flange portions 25*c* (FIG. 4) and 25*d* (FIG. 6) are received in equivalent cavities 47 radially outside the cavity 44*d*. After keys 25 are fixed in place the radial outer faces of the keys are ground down flush with outer face 44*c* of the anchoring section 44, after which the sleeve-shaped cover 48 is screwed tightly on the anchoring section 44 by means of equivalent threaded portions, at the same time as the remainder of the cover 48 is shrunk on the anchoring section over the major portion of its longitudinal dimension.

A characteristic feature of the present invention is that the flushing device can be adjusted as required from conventional single-current drilling liquid flow through the drill head to a two-current drilling liquid flow, e.g., with a first current through the drill head and a second current sideways through the flushing device. A second characteristic feature is that the readjustment from single-current to two-current drilling liquid flow and back to single-current drilling liquid flow is mechanically repeatable, e.g., controllable by way of mechanical means, such as alternating tension loading or alternating pressure loading relative to the upstream end of the flushing device. Furthermore, the flow relationship of the flushing device can be regulated with a distribution determined in advance of the flow through the drill head and outwardly through the nozzles 29.

In other words, based on the afore-mentioned principles, the relative percentage flow one aims to achieve through the boring head/drill head and through the nozzles by a corresponding choice of the current nozzle cross-section of the nozzles 29 can be established in advance.

Figure 4:
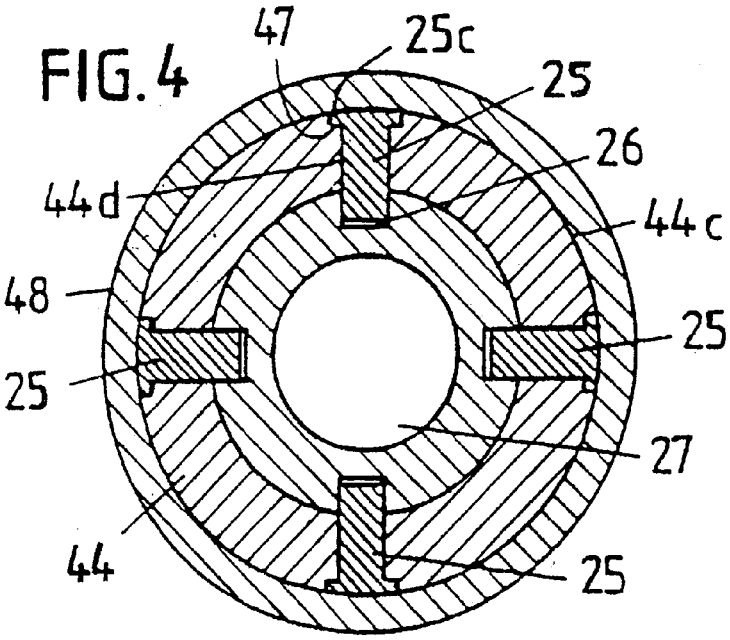
FIG. 4 shows a cross-section of the flushing member.

The mechanism for activating the closing and opening function of the valve is evident from FIG. 2, 3 and 4. The principle is briefly, that the said four keys 25 are guided into a cooperating set of four profiled slots 26 in the valve part 21, which carry out the closing and locking function. The bottom groove of the slot 26 can have a J-shaped contour or inclined plane contour or like contour, all according to the choice of valve arrangement (inclined plane by choice of "beehive" valve.

With the arrangement according to the invention in a ready mounted condition, it becomes situation-conditioned mounted into the drill pipe at a certain distance from the drill head, as is indicated in FIG. 1.

Upon drilling, the arrangement operates so that the valve part 23 of the flushing member 20 is held via the keys 25 pressured against the bottom of the slots 26 in the valve part 21. When desired, flushing the valve member 21 is accomplished when drawn back relative to the valve part 23, such that the valve is opened, and a portion of the liquid flow is diverted from the passage 27/28 via the nozzles 29 to the annular space outside the flushing member 20.

Drilling can be with a maximum liquid flow through an inactive flushing member 20 towards the drill head, such a maximum liquid flow generally being necessary for the drilling. After having drilled to a desired length, for example 10–30 m, the hole can be elected to be cleaned of drill crushings before it is drilled further with maximum liquid flow.

Periodically, the lifting of the drill pipe/drill stem a distance upwards means that the inner valve part 21 can slide upwards along the inner side of the outer valve part 23 and uncover a by-pass passage from the passage 27/28 via the nozzles 29 towards the surrounding annular space. At the same time the slots 26 and the (cooperating) keys 25 provide for adjusting the valve into a fully open position. By pre-dimensioning the radial bores 30 in the valve part 23, one can ensure that the flow of liquid is distributed (for example 60% outwardly through the radial bores 30, while the remaining 40% is led to the drill head for cooling, and for possible operation of a hydraulic, drilling liquid motor also during the flushing operation).

This procedure can be repeated as often as is found necessary/desirable with respect to situation-conditioned needs in all types of wells.

I claim:

1. An arrangement for flushing upwards into an annular space between a drill pipe or a drill stem, which is composed of several pipe sections, and a bore hole wall or between a drill pipe/drill stem and a lining pipe, in an underground well, where pressure liquid is led with an axial liquid flow so as to drive a drill head or a hydraulic sludge motor and where the pressure liquid is used in addition for flushing in the annular space, where a flushing member with nozzles is inserted in the drill pipe/drill stem, which is directed obliquely backwards in the annular space between the flushing member and the side walls of the bore hole, and where the flushing member forms a remotely controllable valve comprising two mutually slidable valve parts, wherein the valve parts consists of an outer sleeve-formed valve part and an inner sleeve-shaped valve part, which are slidable directly under mutual support and connected directly to their respective sections of the drill pipe, the outer valve part forming a valve-seat member, in which the nozzles are designed in an annular series together with passages between the nozzles and valve openings in the valve seat member, the inner valve part forming a slide-formed valve body for opening and closing the valve openings, and wherein that the valve parts are axially moveable a limited length of movement relative to each other by remote regulation of the tension loading in the drill pipe/drill stem, and a means for cushioning and balancing the axial movement of the valve parts relative to each other comprise pressure liquid chambers located between the valve parts.

2. The arrangement in accordance with claim 1, wherein said outer valve part is in permanent turning engagement with a first drill pipe section which carries the drill head and the inner valve part is in permanent turning engagement with a second drill pipe section which is remotely controlled from the surface of the earth;

the mutually axially displaceable valve parts being connected to each other for permanent turning via key/slot connections between the valve parts.

3. The arrangement in accordance with claim 1, wherein the downstream end edge of the valve body forms a piston face for compulsive displacement of the valve body in a direction towards the open position relative to the valve seat member.

4. The arrangement in accordance with claim 3, wherein the downstream end edge of the valve body is arranged upstream just in front of the central passage for passing liquid through the valve seat member.

* * * * *